US011834829B2

(12) United States Patent
Carter

(10) Patent No.: US 11,834,829 B2
(45) Date of Patent: Dec. 5, 2023

(54) FIXTURE-READY BLOCK

(71) Applicant: John Clinton Carter, Tuscumbia, AL (US)

(72) Inventor: John Clinton Carter, Tuscumbia, AL (US)

( * ) Notice: Subject to any disclaimer, the term of this patent is extended or adjusted under 35 U.S.C. 154(b) by 9 days.

(21) Appl. No.: 17/752,924

(22) Filed: May 25, 2022

(65) Prior Publication Data

US 2022/0381030 A1 Dec. 1, 2022

Related U.S. Application Data

(60) Provisional application No. 63/192,747, filed on May 25, 2021.

(51) Int. Cl.
*E04C 1/39* (2006.01)

(52) U.S. Cl.
CPC ..... *E04C 1/397* (2013.01)

(58) Field of Classification Search
CPC .... E04C 1/397; E04C 137/359; E04C 285/46; E04C 174/54
See application file for complete search history.

(56) References Cited

U.S. PATENT DOCUMENTS 3,278,201 A * 10/1966 Noland ..... F16L 5/00 285/46
4,473,244 A * 9/1984 Hill ..... E03B 7/12 285/46
6,417,447 B1 * 7/2002 Bosse, Jr. ..... H02G 3/10 174/505
6,740,810 B1 * 5/2004 Regueiro ..... H02G 3/16 174/64
6,825,414 B2 * 11/2004 Vagedes ..... H02G 3/123 439/535
7,055,863 B1 * 6/2006 Commeville ..... F16L 5/02 52/220.8
7,676,993 B2 * 3/2010 Bonshor ..... F21S 8/033 52/61
8,881,468 B2 * 11/2014 McMullen ..... F21V 21/02 52/302.1
9,222,244 B2 * 12/2015 Holt ..... E03B 9/025
9,337,647 B2 * 5/2016 Gilleran ..... F16L 5/02
9,651,174 B2 * 5/2017 Lechuga ..... F16L 21/03
2019/0127976 A1 * 5/2019 Donnelly ..... E02B 3/06

* cited by examiner

*Primary Examiner* — Patrick J Maestri
(74) *Attorney, Agent, or Firm* — Ryan J. Letson; Bradley Arant Boult Cummings LLP

(57) ABSTRACT

Brick or block walls are often constructed before fixtures, such as faucets, are installed. Sometimes this occurs because the fixture has not yet been selected, or because an installation location for the fixture is unknown. Thus, workers often need to modify the wall to receive fixtures once selected. However, other times, a builder may know where a fixture should be installed, and the type of fixture it will be. In these instances, a fixture-ready block may be selected based on the type and location of the fixture and installed at the proper location when the wall is built. The block may have apertures with dimensions selected based on a fixture that will be installed in the block. This may eliminate the need to drill or bore through the wall after it is finished in order to install the fixture.

20 Claims, 9 Drawing Sheets

FIXTURE-READY BLOCK

RELATED APPLICATIONS

This application claims the benefit of U.S. provisional application No. 63/192,747, filed May 25, 2021, the contents of which is incorporated herein by reference in its entirety.

RELATED ART

Using current residential construction techniques, brick walls are often constructed before fixtures, such as outdoor faucets, are installed. Installation of a fixture often requires boring a new hole in the brick wall after it has been constructed. This invasive approach damages bricks of the wall and can weaken the wall or otherwise compromise its integrity. It also transfers loads experienced by the faucet on the exterior of the wall to interior plumbing, increasing strain on the plumbing and reducing the plumbing's usable lifespan (e.g., time until the plumbing fails). This can lead to costly and invasive repairs. Improved techniques for installing fixtures in walls of residential structures are generally desirable.

BRIEF SUMMARY

The problems described above, as well as others, are addressed by the following embodiments, although it is to be understood that not every embodiment of this disclosure will address each of the problems described above. Further advantages, features, and details of the embodiments can be gathered from the claims, the description of preferred embodiments below, as well as the drawings.

In one aspect, the present disclosure relates to a block for locating a plumbing fixture. In various embodiments, the block comprises an exterior side aperture, wherein a midpoint of the exterior side aperture is located at a first distance from a bottom side of the block; an interior side aperture, wherein a midpoint of the interior side aperture is located at a second distance from a bottom side of the block, wherein the first distance is less than the second distance; a volume between the exterior side aperture and the interior side aperture, wherein the volume is defined by at least a first and second interior partition, and wherein the first and second interior partition prevent incursion of a bonding material into the volume that would otherwise obstruct insertion of one or more portions of the plumbing fixture through the exterior side aperture and the interior side aperture.

In embodiments, the block comprises one or more of aluminum, steel, and brick. The block can further comprise a plurality of recesses on a top surface of the block configured to receive a bonding material. In embodiments, the block comprises a textured surface on an exterior side of the brick. The block can include a finish applied to the textured surface. In certain embodiments, one or more of the exterior side aperture and interior side aperture is threaded. In certain embodiments, a diameter of one or more of the exterior side aperture and interior side aperture is selected based on a diameter of a pipe portion of the fixture. The block can further comprise a reinforcing portion around one or more of the exterior side aperture and interior side aperture.

In another aspect, the present disclosure relates to a block for locating a plumbing fixture comprising: an exterior side aperture; an interior side aperture; a plurality of recesses disposed upon a top side of the block; and a channel extending between the exterior side aperture and the interior side aperture, wherein the channel is configured to receive and hold at least a portion of the plumbing fixture or a piping. In certain embodiments, a midpoint of the exterior side aperture is located at a first distance from a bottom side of the block; and a midpoint of the interior side aperture is located at a second distance from a bottom side of the block, wherein the first distance is less than the second distance. The block can further include a volume between the exterior side aperture and the interior side aperture, wherein the volume is defined by at least a first and second interior partition. In some embodiments, the block comprises a plurality of recesses disposed upon a bottom side of the block.

In embodiments, at least a medial portion of the block is hollow, and the channel comprises a tubular structure that extends continuously from the exterior side aperture to the interior side aperture. In alternate embodiments, at least a medial portion of the block is substantially solid, and the channel comprises a hole extending from the exterior side aperture and the interior side aperture.

In yet another aspect, the present disclosure relates to a method of locating a plumbing fixture. In embodiments, the method comprises providing any of the various fixture-ready blocks as disclosed herein. The method can further comprise providing the plumbing fixture and a piping; passing the piping through the interior side aperture; passing at least a portion of the plumbing fixture through the exterior side aperture; and securing an exterior side of the plumbing fixture to an exterior side of the block.

The above presents a simplified summary in order to provide a basic understanding of some aspects of the claimed subject matter. This summary is not an extensive overview. It is not intended to identify key or critical elements or to delineate the scope of the claimed subject matter. Its sole purpose is to present concepts in a simplified form as a prelude to the more detailed description that is presented later.

BRIEF DESCRIPTION OF THE DRAWINGS

The disclosure can be better understood with reference to the following drawings. The elements of the drawings are not necessarily to scale relative to each other, emphasis instead being placed upon clearly illustrating the principles of the disclosure. Furthermore, like reference numerals designate corresponding parts throughout the several views.

Figure 1:
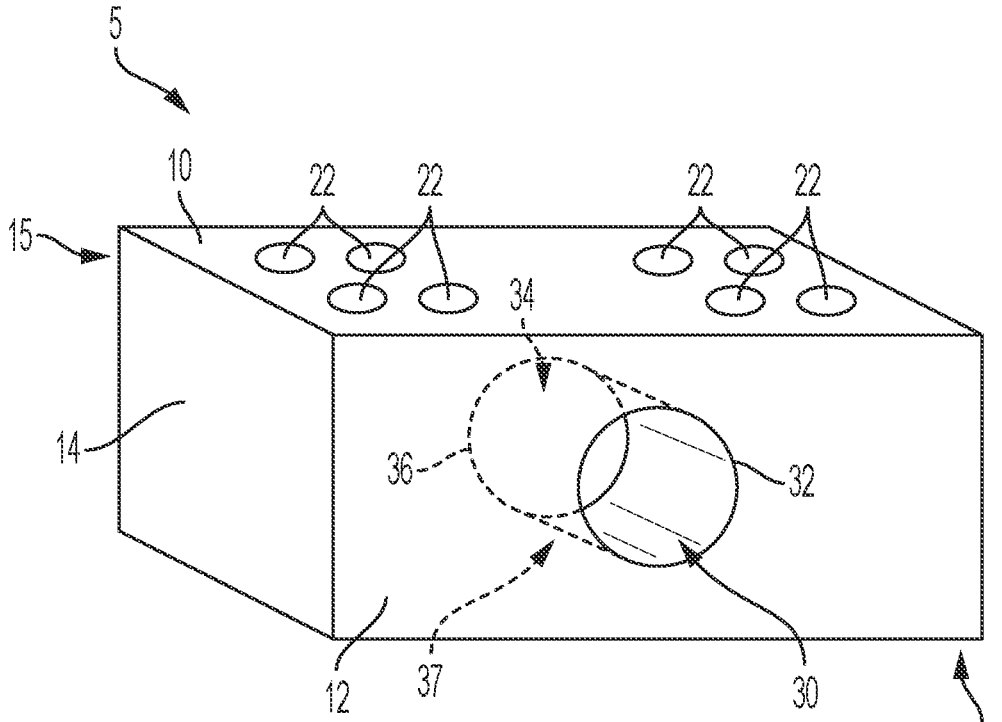
FIG. 1 is a three-dimensional front perspective view of a fixture-ready block in accordance with some embodiments of the present disclosure.

Additional description of aspects of some embodiments of the present disclosure may be found in U.S. provisional application No. 63/192,747, which is hereby incorporated by reference herein in its entirety.

DETAILED DESCRIPTION

A. Definitions

Unless otherwise defined, all terms (including technical and scientific terms) used herein have the same meaning as commonly understood by one of ordinary skill in the art of this disclosure. It will be further understood that terms, such as those defined in commonly used dictionaries, should be interpreted as having a meaning that is consistent with their meaning in the context of the specification and should not be interpreted in an idealized or overly formal sense unless expressly so defined herein. Well known functions or constructions may not be described in detail for brevity or clarity.

The terms "about" and "approximately" shall generally mean an acceptable degree of error or variation for the quantity measured given the nature or precision of the measurements. Typical, exemplary degrees of error or variation are within 20 percent (%), preferably within 10%, and more preferably within 5% of a given value or range of values. Numerical quantities given in this description are approximate unless stated otherwise, meaning that the term "about" or "approximately" can be inferred when not expressly stated.

It will be understood that when a feature or element is referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments.

The terminology used herein is for the purpose of describing particular embodiments only and is not intended to be limiting. As used herein, the singular forms "a", "an" and "the" are intended to include the plural forms as well, unless the context clearly indicates otherwise.

Spatially relative terms, such as "under", "below", "lower", "over", "upper" and the like, may be used herein for ease of description to describe one element or feature's relationship to another when the apparatus is right side up.

The terms "first", "second", and the like are used herein to describe various features or elements, but these features or elements should not be limited by these terms. These terms are only used to distinguish one feature or element from another feature or element. Thus, a first feature or element discussed below could be termed a second feature or element, and similarly, a second feature or element discussed below could be termed a first feature or element without departing from the teachings of the present disclosure.

Terms such as "at least one of A and B" should be understood to mean "only A, only B, or both A and B." The same construction should be applied to longer list (e.g., "at least one of A, B, and C").

The term "consisting essentially of" means that, in addition to the recited elements, what is claimed may also contain other elements (steps, structures, ingredients, components, etc.) that do not adversely affect the operability of what is claimed for its intended purpose as stated in this disclosure. Importantly, this term excludes such other elements that adversely affect the operability of what is claimed for its intended purpose as stated in this disclosure, even if such other elements might enhance the operability of what is claimed for some other purpose.

In some places reference is made to standard methods, such as but not limited to methods of measurement. It is to be understood that such standards are revised from time to time, and unless explicitly stated otherwise reference to such standard in this disclosure must be interpreted to refer to the most recent published standard as of the time of filing.

B. Fixture-Ready Block

Brick or block walls are often constructed before fixtures, such as faucets, are installed. Sometimes this occurs because the fixture has not yet been selected, or because an installation location for the fixture is unknown. Thus, workers often need to modify the wall to receive fixtures once selected.

However, other times, a builder may know where a fixture should be installed, and the type of fixture it will be. In these instances, a fixture-ready block may be installed to avoid the need to create an entry point for the fixture later. The block can be selected based on the type and dimensions of the fixture and may be installed at the proper location when the wall is built. This may eliminate the need to drill or bore through the wall after it is finished in order to install the fixture.

FIG. 1 is a three-dimensional perspective view of a fixture-ready block 5 in accordance with some embodiments of the present disclosure. It will be appreciated that some features of the block 5 are shown in other figures, and not shown explicitly in FIG. 1. In the embodiment of FIG. 1, the block 5 has a top side 10, a front side 12, two lateral sides 14 (only one lateral side is shown in FIG. 1, but it will be appreciated that there is another lateral side 14 is on an opposite side of the block 5). The block 5 also has an interior side (also referred to herein as the "back side) 15 and a bottom side 16, neither of which is specifically shown in FIG. 1, but which are numbered for general reference.

The block 5 may have apertures 30, 34 configured to receive a portion of a fixture or piping (not specifically shown). The apertures 30, 34 allow a portion of a fixture or piping to pass through the block 5 (e.g., a pipe for providing water to a faucet that may be mounted on the front side of the block 5). The block 5 has an exterior side aperture 30 with an exterior side rim 32, as well as an interior side aperture 34 and interior side rim 36. The rims 32 and 36 may refer to respective portions of the exterior side 12 surrounding the exterior side aperture 30 (as to the exterior side rim 32), and of the interior side 15 surrounding the interior side aperture 34 (as to the interior side rim 36). In some embodiments, the exterior side rim 32 may have a thickness that is approximately the same as the exterior side 12. Likewise, in some embodiments, the interior side rim 36 may have a thickness that is approximately the same as the interior side 15. In some embodiments, one or both of the rims 32 and 36 may be threaded.

The apertures 30, 34 and corresponding rims 32 and 36 are depicted as having a roughly round or circular cross-sectional shape, but other cross-sectional shapes are possible in other embodiments. In some embodiments, a cross-sectional shape of aperture 30, 34 may correspond to a cross-sectional shape of a portion of the fixture that will be inserted into the aperture 30, 34.

As shown in FIG. 1, some embodiments comprise a channel 37 having a length that extends between the apertures 30, 34. In such embodiments, the channel 37 creates a continuous opening that extends entirely from the interior side 15 to the exterior side 12 of the block 5. The channel 37 can provide added strength and support for the fixture (see, e.g., 100 at FIGS. 7A-8B). In hollow embodiments, the channel 37 may comprise a barrier that prevents bonding material from obstructing a path between the apertures 30, 34, thus ensuring a clear path through the block to install a fixture. In some embodiments, the channel 37 may comprise a tube extending from the aperture 30 on the front side 12 to the aperture 34 on the back side 15. Although the channel 37 is shown as substantially cylindrical, in alternate embodiments a cross-sectional profile of the channel 37 taken along its longitudinal axis may vary (e.g., may be conical or tapered, etc.). The channel 37 can comprise any known geometric cross-sectional shape. By way of example the cross-sectional shape of channel 37 can be a rhombus, a parallelogram, a trapezoid, or a combination thereof. The cross-sectional shape of the channel 37 can be substantially circular. In embodiments, the cross-sectional shape of the channel 37 is a rectangle, a square, a triangle, a pentagon, a hexagon, a heptagon, an octagon, a nonagon, a decagon, or an oval. In embodiments, a cross-sectional profile of the channel comprises a shape that is substantially similar to that of at least one of the exterior aperture 30 and the interior aperture 34. Further, in some embodiments, a profile of the channel 37 may correspond to a shape of a portion of the fixture that will be installed in the block 5 and which will pass through the block 5 via the apertures 30, 34. A length of channel 37 may be partly or completely threaded in some embodiments.

One or more features of the block 5 may be insulated. This may include all or a portion of sides of the block 5 (e.g., top side 10, front side 12, lateral sides 14, interior side 15 and bottom side 16), including portions of rims 32 and 36 around apertures 30, 34, as well as all or portions of channel 37. The block 5 may be made from one or more materials having a desired insulating property. Non-limiting examples of materials with an insulating property include plastic or rubberized plastic or foam, such as expandable foam insulation. In embodiments, the block can comprise an insulation material disposed inside of the block. In some embodiments, insulation may be coupled to a surface of the block 5 (e.g., using an adhesive), which may be an interior or exterior surface of a feature of block 5 (see, e.g., FIGS. 9A & 9C). Exemplary insulating materials that may be coupled to the block 5 include rubberized textured coating, plasticized coating, or insulated block material.

In some embodiments, the block 5 may comprise at least one recess 22 extending at least partially through at least one surface of the block 5. The at least one recess 22 can be configured to receive a bonding material (e.g., mortar, not specifically shown) applied to the block 5. The recesses 22 provide surface area in addition to surface area of a side of the block 5 (e.g., the top side 10, bottom side 12 or lateral sides 14) with which the bonding material contacts and adheres (e.g., when cured or hardened). In some embodiments, the recesses 22 may be indentations having a depth that allows desired bonding with a selected bonding material. Embodiments can comprise a plurality of recesses 22 on at least one surface of the block 5. Some embodiments comprise up to fifty recesses 22 on at least one surface of the block 5. Embodiments comprise up to twenty recesses 22 on at least one surface of the block 5. The block 5 can comprise one, two, three, four, five, six, seven, eight, nine, ten, eleven, twelve, thirteen, fourteen, fifteen, sixteen, seventeen, eighteen, nineteen, or twenty recesses 22.

In some embodiments, the recesses 22 may extend at least partially into the bock 5. In embodiments, the recesses 22 may be holes extending entirely through at least one side of the block 5, and thus may allow bonding material to pass through one or more sides of the block 5 and enter into an interior volume of the block 5.

Figure 2:
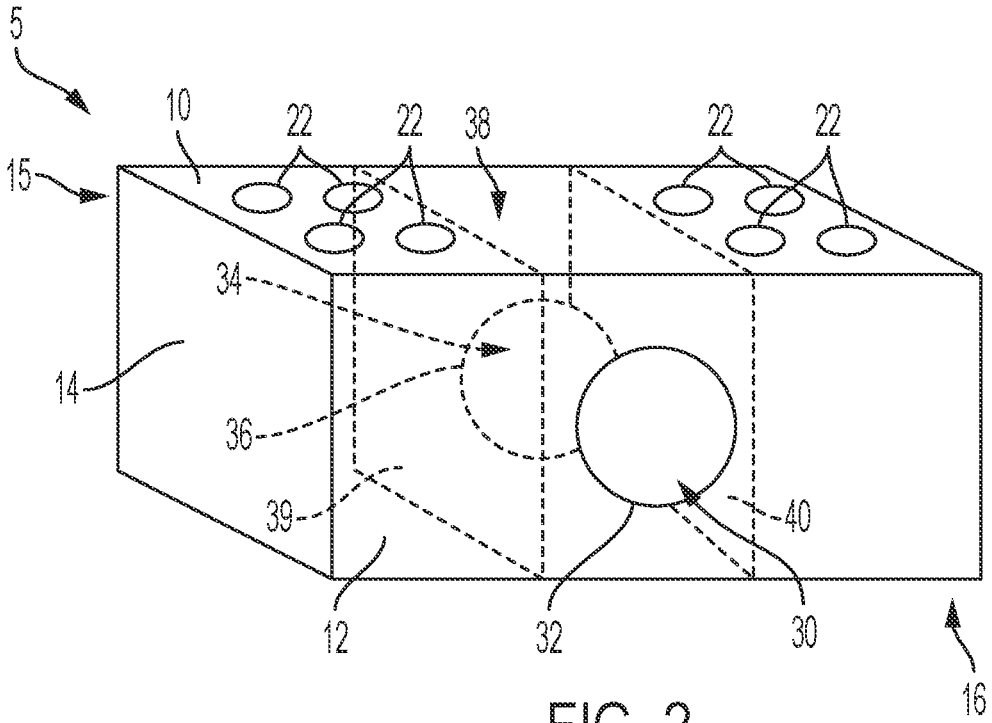
FIG. 2 provides a three-dimensional front perspective view of a fixture-ready block in accordance with additional embodiments of the present disclosure.

As shown in FIG. 2, the channel may be absent in some embodiments. In such embodiments, the block 5 can comprise a hollow portion. In certain embodiments, the entire block 5 is hollow. In embodiments, only a portion of the block 5 is hollow. As shown in FIG. 2, at least a medial portion can be hollow such that an interior volume 38 exists within the block. The interior volume 38, can be defined by a portion of the top side 10, a portion of the bottom side 16, a first interior partition 39 and a second interior partition 40. In hollow embodiments that lack a channel 37, the partitions can be configured to prevent bonding material from entering the interior volume 38 and potentially obstructing the path between the apertures 30, 34 needed to install a fixture.

In some embodiments, the block 5 comprises each of a channel 37 and partitions 39, 40 within the interior volume 38. Some embodiments comprise an interior volume 38 that lacks partitions and is defined by a surface of a channel 37 (see, e.g., FIG. 1).

In certain embodiments, the medial portion of the block is substantially solid, and the lateral portions of the block are hollow. For example, the portion of the block surrounding the channel 37 can be solid (such that the channel 37 exists as a hole extending from the aperture 30 on the front side 12 of the block 5 to the aperture 34 on the back side 15 of the block 5), and the portion of the block 5 corresponding with the recesses 22 is hollow such that bonding material may enter the lateral portions of the block without obstructing the channel 37.

In alternate embodiments, the lateral portions can be substantially solid, and the medial portion can be hollow such that the interior volume 38 exists between two solid portions. In such embodiments, the recesses 22 can extend at least partially into the lateral portions of block. In embodiments, wherein the lateral portions of the block 5 are substantially solid the recesses 22 can comprise one or more holes that extend entirely from the top surface 10 of block to the bottom surface 16 of the block 5.

In some embodiments, the entire block 5 is solid. In such embodiments, the channel 37, the recesses 22, or a combination thereof, can exist as holes extending entirely through the block. For instance, in solid embodiments, the channel 37 can extend from the aperture 30 on the front side 12 of the block 5 to the aperture 34 on the back side 15 of the block 5, and one or more recesses can exist as (i) a cavity or indentation extending partially into the block, (ii) a hole extending entirely from the top surface 10 of block to the bottom surface 16 of the block 5, or (iii) a combination thereof. The block 5 may have other features in other embodiments.

FIGS. 3-6 provide various views and exemplary dimensions of a fixture-ready block in accordance with some embodiments of the present disclosure. The figures show additional exemplary arrangements, locations, and dimensions of the features of the block 5. Exemplary dimensions include those utilized for a standard brick (e.g., 3⅝"×2¼"×8"); a modular brick (e.g., 3⅝"×2¼"×7⅝") or; a jumbo standard (e.g., 3⅝"×2¾"×8"). In alternate embodiments, the block is approximately 2.5" tall, 2.5" deep, and 8" long (e.g., the top side 10 (FIG. 3) and bottom side 16 (FIG. 4) are each 2.5" deep 553, 565 and 8" long 551, 563; the front side 12 (FIG. 5) and interior side 15 (FIG. 6) are each 8" long 555, 559 and 2.5" high 557, 561; and the lateral sides 14 are each 2.5" tall 557, 561 and 2.5" deep 553, 565). Additional dimensions or combinations of dimensions can also exist. In embodiments, the height 557, 561 of the block 5 is about 2". The height 557, 561 of the block 5 can be between about 1" and about 12". In embodiments, the height 557, 561 is about 0.5", about 1.0", about 1.5", about 2.0", about 2.5", about 3.0", about 3.5", about 4.0", about 4.5", about 5.0", about 5.5", about 6.0", about 6.5", about 7.0", about 7.5", about 8", about 8.5", about 9.0", about 9.5", or about 10.0". In embodiments, the length 551, 555, 559, 563 of the block 5 is up to about 36". The length 551, 555, 559, 563 of the block can be between 2" and 24". In embodiments, the length 551, 555, 559, 563 of the block is about 3.0", about 3.5", about 4.0", about 4.5", about 5.0", about 5.5", about 6.0", about 6.5", about 7.0", about 7.5", about 8", about 8.5", about 9.0", about 9.5", about 10.0", about 10.5", about 11.0", about 11.5", about 12.0", about 12.5", about 13.0", about 13.5", about 14.5", about 15.0", about 15.5", about 16.0", about 16.5", about 17.0", about 17.5", about 18.0", about 18.5", about 19.0", about 19.5", or about 20.0". In embodiments, the depth 553, 565 of the block 5 is about 3". The depth 553, 565 of the block 5 can be between about 1" and about 12". In embodiments, the depth 553, 565 is about 0.5", about 1.0", about 1.5", about 2.0", about 2.5", about 3.0", about 3.5", about 4.0", about 4.5", about 5.0", about 5.5", about 6.0", about 6.5", about 7.0", about 7.5", about 8", about 8.5", about 9.0", about 9.5", or about 10.0". The dimensions of the block 5 can include any dimension that is commonly utilized or standard within the relevant industry worldwide. Note that there are multiple standard sizes of brick. The sizes listed above are the most common or standard but are not to be interpreted as limiting unless specifically stated. It will be understood that such exemplary details are provided for illustrative purposes only, and that various configurations are within the scope contemplated by the present disclosure.

Figure 3:
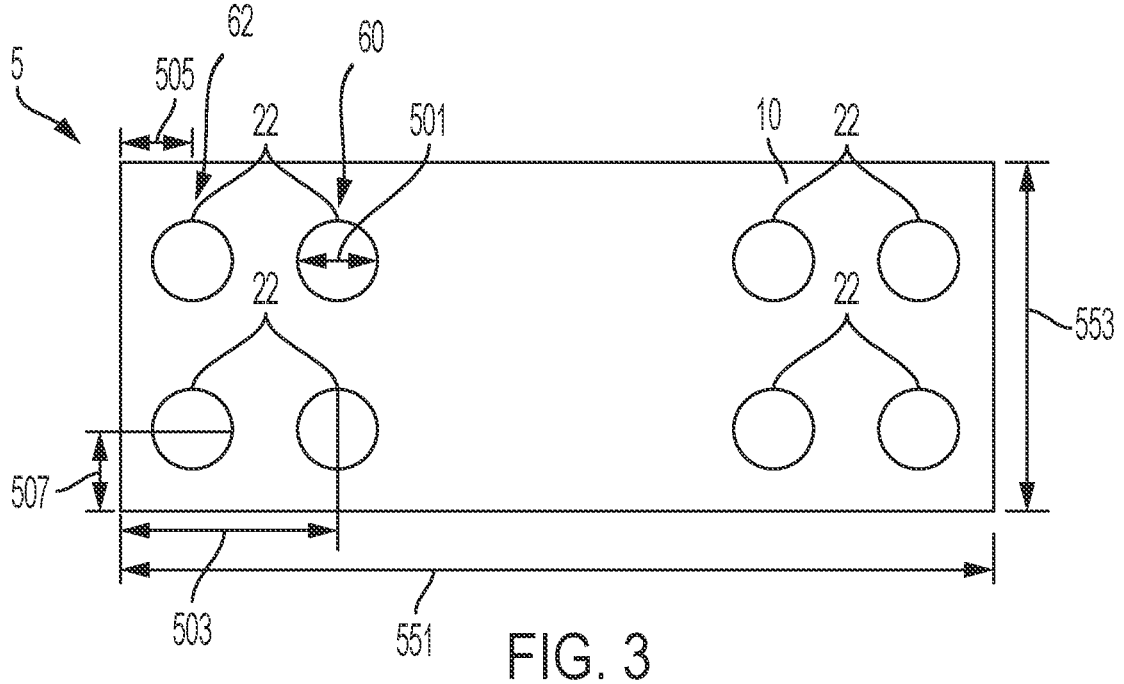
FIG. 3 is a top view of a fixture-ready block in accordance with some embodiments of the present disclosure.
Figure 4:
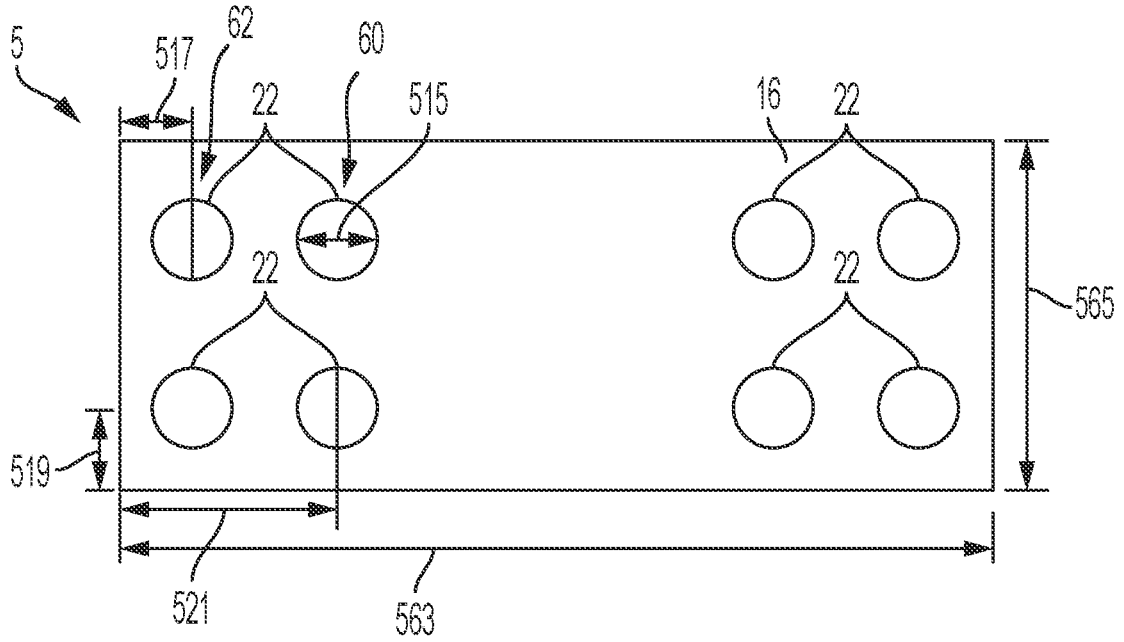
FIG. 4 is a bottom view of a fixture-ready block in accordance with some embodiments of the present disclosure.
Figure 5:
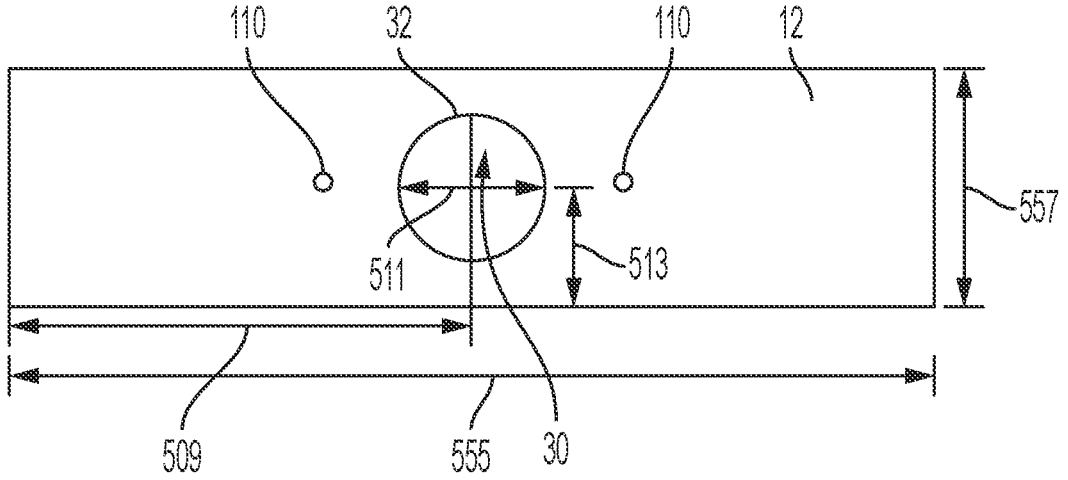
FIG. 5 is a front view of a fixture-ready block in accordance with some embodiments of the present disclosure.
Figure 6:
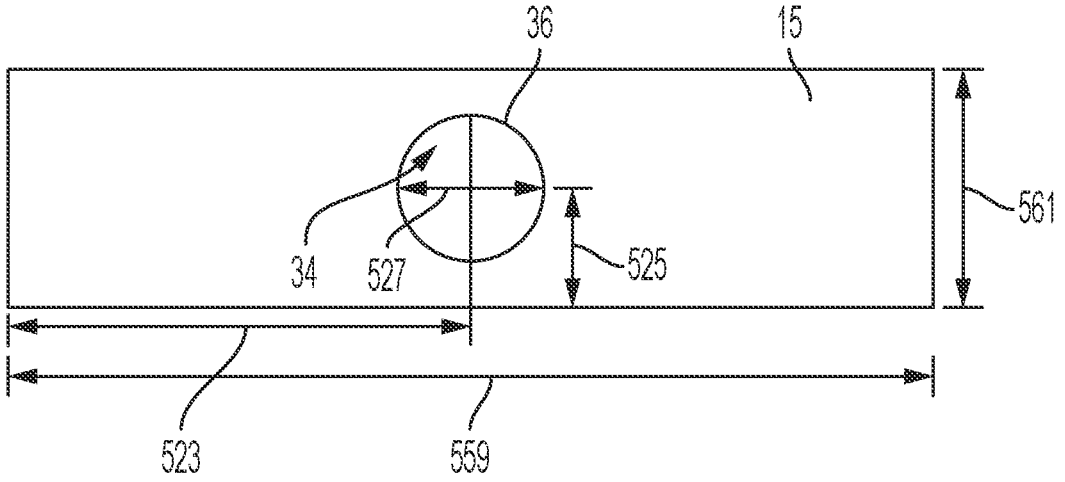
FIG. 6 is a back view of a fixture-ready block in accordance with some embodiments of the present disclosure.

FIG. 3 is a top view of a fixture-ready block; FIG. 4 is a bottom view of a fixture-ready block; FIG. 5 is a front view of a fixture-ready block; and FIG. 6 is a back view of a fixture-ready block in accordance with some embodiments of the present disclosure.

In the illustrated embodiment, front side 12, the interior side 15, or both may be approximately 8" long 555, 559 and 2" high 557, 561, although in some embodiments, such length 555, 559 may be approximately between 3⅛" and 7⅝", and such height 557, 561 may be approximately between 2¼" and 7⅝". One or more of the lateral sides 14 may be approximately 3" deep 553, 565 and 2" high 557, 561, although in some embodiments, such depth 553, 565 may be approximately between 3⅛" and 7⅝", and such height 557, 561 may be approximately between 2¼" and 7⅝". The top side 10 and bottom side 16 may be approximately 8" long 551, 563 and 3" deep 553, 565, although in some embodiments, such length 557, 561 may be approximately between 3⅛" and 7⅝", and such depth 553, 565 may be approximately between 2¼" and 7⅝".

The block 5 may have recesses 22 which are approximately circular in cross-sectional shape, and approximately ¾" in diameter 501, 515. An approximate center of each respective recess 22 in an innermost row 60 of recesses 22 may have an inner recess center distance 503, 521 of approximately 2" from a lateral side 14 of the block 5; an approximate center of each respective recess 22 in an outermost row 62 of recesses 22 may have an outer recess center distance 505, 517 of approximately ¾" from a lateral side 14 of the block 5.

Apertures 30, 34 may have an aperture center distance 509, 523 that is approximately 4" from a lateral side 14 of the block 5 and may have an aperture diameter 511, 527 of approximately 1¼".

With specific reference to FIGS. 5-6, note that apertures 30, 34 may be positioned on respective sides of the block 5 based on a desired performance of the fixture (seen for example at 100 of FIGS. 7A-8B), based on compliance with an applicable standard or requirement, based on another consideration for positioning of the fixture (e.g., positioning around or operability with other structures) or various combinations thereof. For example, it may be desirable to install a fixture (seen at 100 of FIGS. 7A-8B) so that an interior side (seen at 102 of FIGS. 8A & 8B) of the fixture 100 is positioned higher above the ground than the exterior side (seen at 104 of 8A & 8B) of the fixture (e.g., to allow moisture to drain away from the interior of the structure and towards the exterior of structure as the moisture leaves the fixture). Such an arrangement may also encourage water to flow toward the exterior of a structure in the event of a sudden burst of water (e.g., freezing pipes) or a slow leak. In this regard, in FIGS. 5 and 6, an approximate center of aperture 30 on the front side 12 may comprise a front aperture center height 513 (also referred to herein as a "first distance") that is approximately ⅛" shorter than a back aperture center height 525 (also referred to herein as a "second distance"). In such embodiments, the center of aperture 30 can be approximately 1/16" lower than a transverse axial centerline of front side 12, and the center of aperture 34 can be approximately 1/16" higher than a transverse axial centerline of interior side or back 15. The apertures may be positioned at other heights in other embodiments.

In some embodiments, an approximate center of aperture 30 on the front side 12 may be offset approximately laterally (e.g., center of aperture 30 is offset along a transverse axial centerline of front side 12) from an approximate center of aperture 34 in the interior side 15 (e.g., center of aperture 34 is offset along a transverse axial centerline of interior side 15). The apertures 30, 34 may be offset along other axes on respective portions or sides of block 5 in some embodiments.

The foregoing features may have various combinations of the same or different dimensions in some embodiments.

Figure 7A:
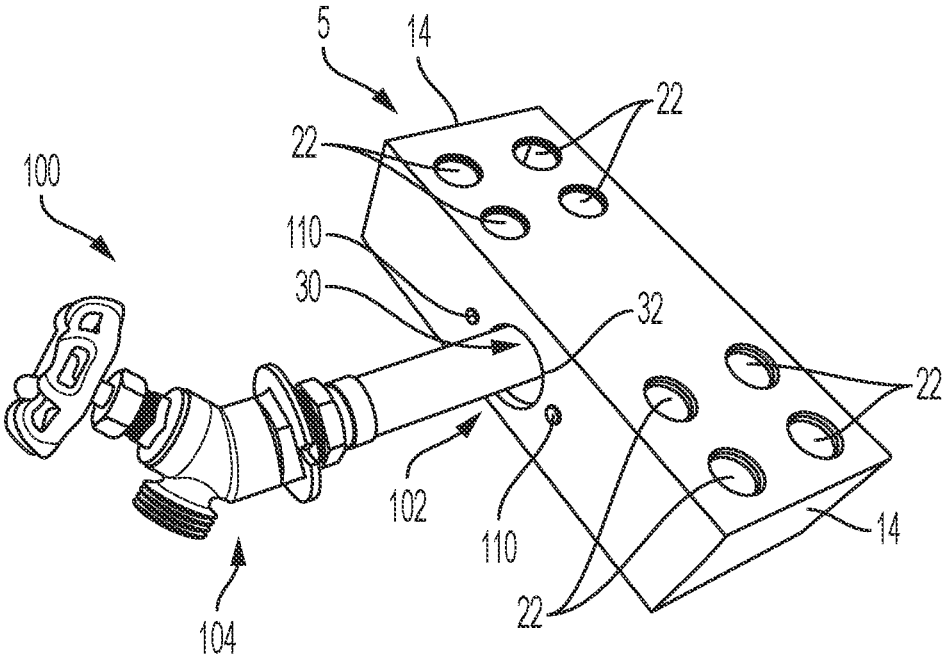
FIG. 7A is a front perspective view of a schematic showing a fixture aligned for installment into a fixture-ready block with sidewalls in accordance with some embodiments of the present disclosure.
Figure 7B:
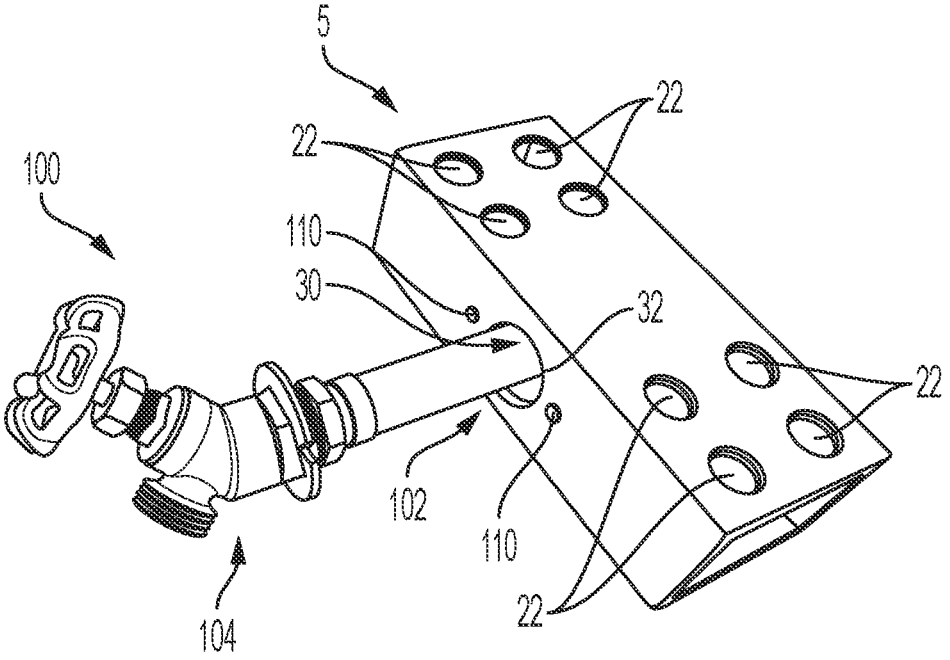
FIG. 7B is a front perspective view of a schematic showing a fixture aligned for installment into a fixture-ready block without sidewalls in accordance with some embodiments of the present disclosure.
Figure 8A:
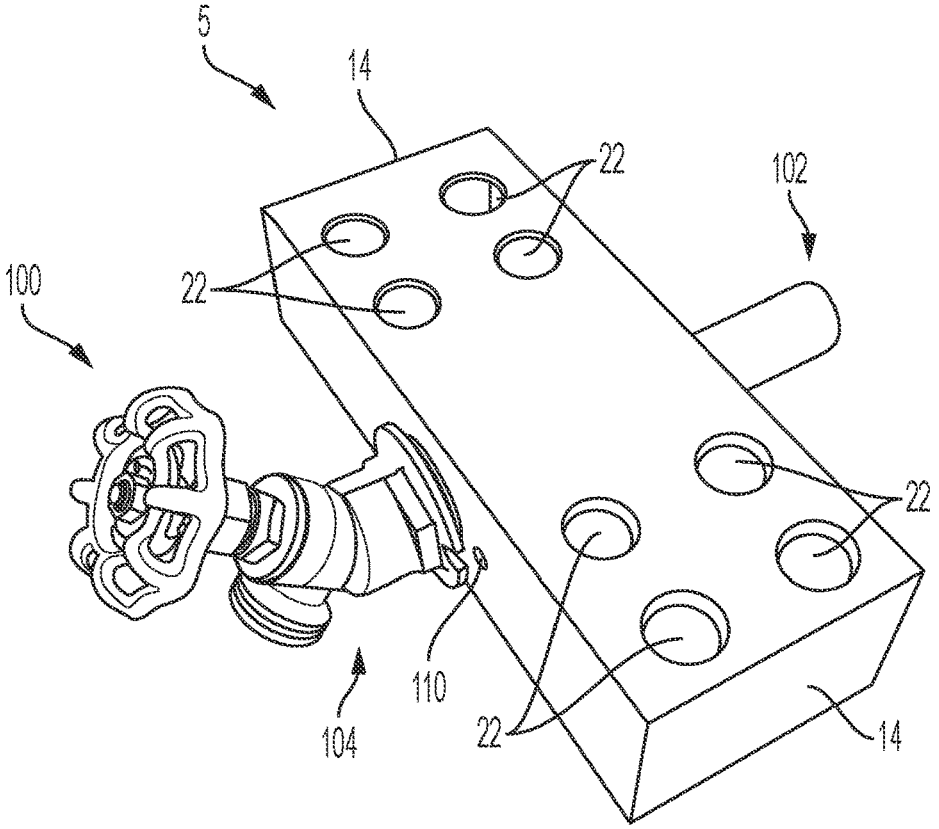
FIG. 8A is a front perspective view of a fixture after installation into a fixture-ready block with sidewalls in accordance with some embodiments of the present disclosure.
Figure 8B:
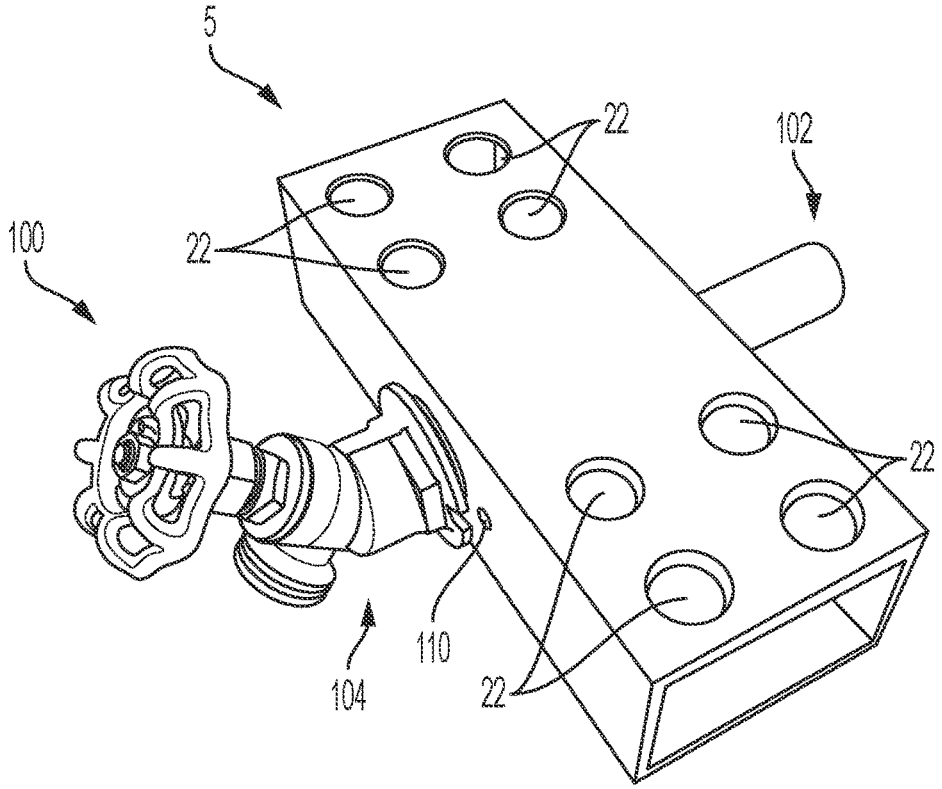
FIG. 8B is a front perspective view of a fixture after installation into a fixture-ready block without sidewalls in accordance with some embodiments of the present disclosure.

FIGS. 7A and 8A provide perspective views of a fixture 100 before installation into a fixture-ready block 5 in embodiments with and without sidewalls 14 (see FIGS. 7A and 7B, respectively); and FIGS. 8A and 8B provide perspective views of a fixture after installation into a fixture-ready block 5 in accordance with some embodiments of the present disclosure with and without sidewalls 14 (see FIGS. 8A and 8B, respectively).

As noted above, the block 5 may receive a fixture 100 by passing through one or both apertures 30, 34. The block 5 may have various openings 110 for receiving fasteners (not shown) for coupling the plumbing fixture 100 to the block 5. Other features are possible in some embodiments.

The fixture 100 in FIGS. 7A-8B is a spigot, but in some embodiments the block 5 can be configured to receive and secure various other types of fixtures. That is, various other fixtures can be mounted using a fixture ready block 5 in some embodiments including but not limited to: pies, bibs, valves, spouts, shower heads, traps, or otherwise (including essentially any fixtures or other components and systems described or standardized by the American Society of Mechanical Engineers (ASME) in its current standards for plumbing fittings and fixtures, for example all parts of any, some or all of the following: ASME A112 (editions 2012, 2018); ASME B1 (editions 1983, 2013); ASME B16 (editions 2006, 2011, 2013, 2018); ASME B31 (editions 2011, 2014, 2017, 2020); ASME Y32 (edition 1977); and all appendices and errata associated with the foregoing and which may be amended subsequently from time to time. Each of the foregoing is hereby incorporated by reference in its entirety.

Figure 9A:
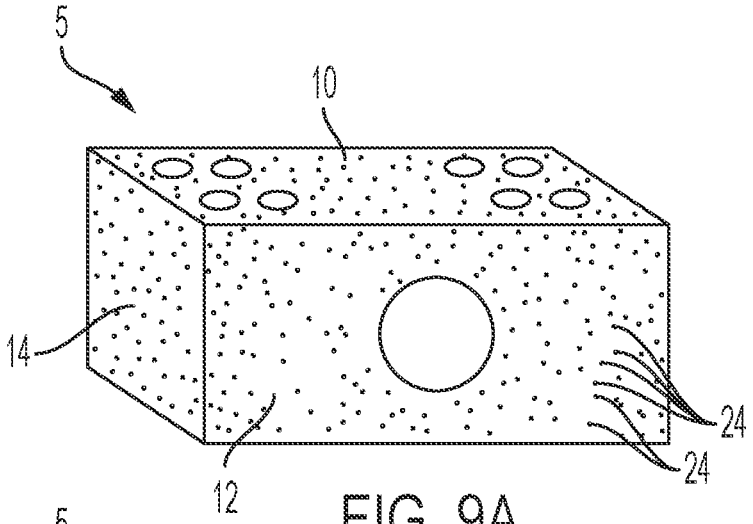
FIG. 9A is a front perspective view of a fixture-ready block that includes a surface texture in accordance with some embodiments of the present disclosure.

FIG. 9A shows an embodiment of the present disclosure that includes an exemplary surface texture 24 on at least a portion of each of the front side 12, top side 10, and sidewall 14. In the FIG. 9A embodiment, the block 5 comprises a surface texture 24 on at least a portion of each of the front side 12, top side 10, and a sidewall 14. Exemplary surface textures 24 can include a smooth texture; a rough texture; a rubberized spray-on coat giving the block a rough surface texture; a textured powder coating mimicking a rough texture; or a smooth acrylic/powder coating giving it a smooth finish.

Figure 9B:
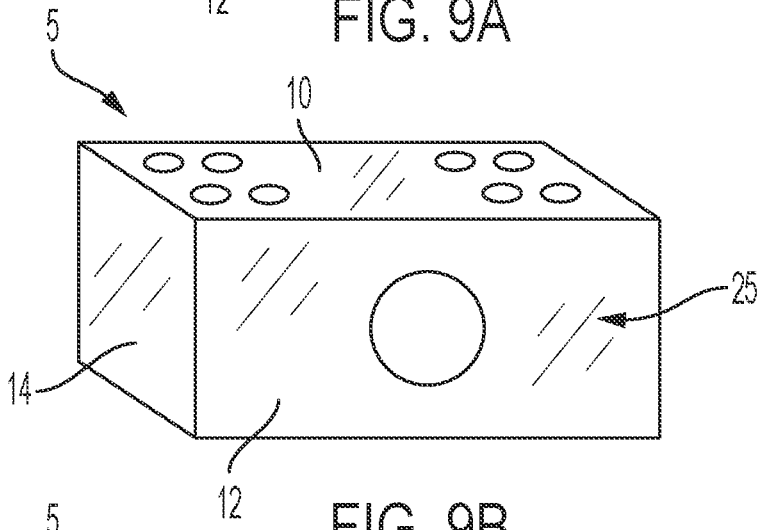
FIG. 9B is a front perspective view of a fixture-ready block that includes a surface finish in accordance with some embodiments of the present disclosure.

In addition, as shown in FIG. 9B, some embodiments comprise a finish 25 on one or more surfaces of the block 5. In FIG. 9B, the embodiment comprises a finish 25 on at least a portion of each of the front side 12, top side 10, and a sidewall 14. The finish 25 can comprise any fluid-applied material that creates barrier on a surface of the block 5. In some embodiments, finish comprises a barrier that protects the block from the direct exposure to the environment. The finish can comprise a decorative material that is applied to at least one surface of the block 5. Non-limiting, exemplary finished comprise paint, urethane, acrylic, powder coating spray-on rubberized surface, plasti-dip surface, or any combination thereof.

Figure 9C:
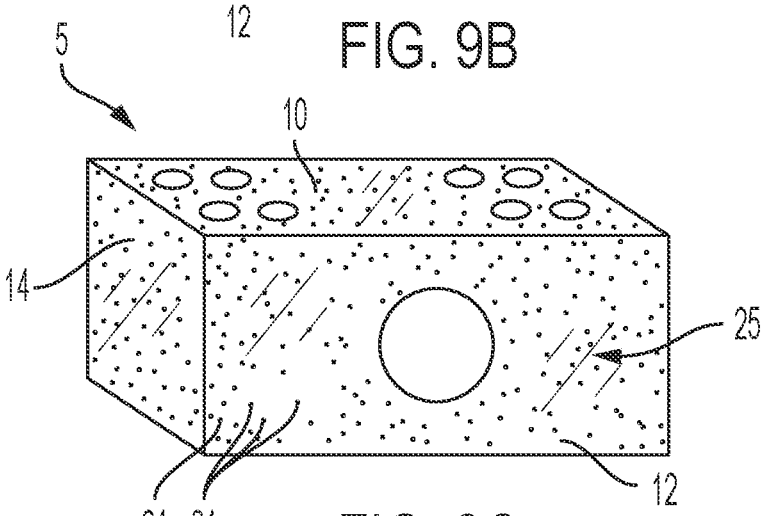
FIG. 9C provides a front perspective view of a fixture-ready block that includes both a surface texture and a surface finish in accordance with some embodiments of the present disclosure.

FIG. 9C provides an embodiment of the present disclosure that includes a surface texture 24 and a finish on at least one surface 25. In FIG. 9C, the embodiment comprises a surface texture 24 and a finish 25 on at least a portion of each of the front side 12, top side 10, and a sidewall 14. In some embodiments, the finish 25 is disposed on top of the surface texture 24 such that the finish 25 is the most exterior layer of the block 5. The surface texture 24 can be disposed on top of the finish 25 such that the surface texture 24 is the most exterior layer of the block.

As shown in the embodiments of FIGS. 9A-9C, one or more of each surface of the block 5 can comprise the surface texture 24, the finish 25, or a combination thereof. The finish 25, the surface texture 24, or both can be present on one surface, two surfaces, three surfaces, four surfaces, five surfaces, or six surfaces of the block 5. In embodiments, the surface texture 24, the finish 25, or both are present on each surface of the block 5. In some embodiments, the surface texture, the finish 25, or a combination thereof covers a substantial portion of at least one surface 10, 12, 14, 15 of the block 5. The surface area 24, finish 25, or a combination thereof can cover the entire face of at least one surface. In certain embodiments, the surface texture 24, finish 25, or a combination thereof covers about 10%, about 20%, about 30%, about 40%, about 50%, about 60%, about, 70%, about 80%, about 90%, or about 100% of at least one surface 10, 12, 14, 15, 16 of the block 5. The surface texture 24, finish 25, or a combination thereof can cover less than 10% of the surface area of at least one surface of the block.

It is to be understood that any given elements of the disclosed embodiments of the invention may be embodied in a single structure, a single step, a single substance, or the like. Similarly, a given element of the disclosed embodiment may be embodied in multiple structures, steps, substances, or the like.

The foregoing description illustrates and describes the processes, machines, manufactures, compositions of matter, and other teachings of the present disclosure. Additionally, the disclosure shows and describes only certain embodiments of the processes, machines, manufactures, compositions of matter, and other teachings disclosed, but, as mentioned above, it is to be understood that the teachings of the present disclosure are capable of use in various other combinations, modifications, and environments and is capable of changes or modifications within the scope of the teachings as expressed herein, commensurate with the skill and/or knowledge of a person having ordinary skill in the relevant art. The embodiments described hereinabove are further intended to explain certain best modes known of practicing the processes, machines, manufactures, compositions of matter, and other teachings of the present disclosure and to enable others skilled in the art to utilize the teachings of the present disclosure in such, or other, embodiments and with the various modifications required by the particular applications or uses. Accordingly, the processes, machines, manufactures, compositions of matter, and other teachings of the present disclosure are not intended to limit the exact embodiments and examples disclosed herein. Any section headings herein are provided only for consistency with the suggestions of 37 C.F.R. § 1.77 or otherwise to provide organizational queues. These headings shall not limit or characterize the invention(s) set forth herein.

I claim:

1. A block for locating a plumbing fixture comprising:

an exterior side aperture, wherein a midpoint of the exterior side aperture is located at a first distance from a bottom side of the block;

an interior side aperture, wherein a midpoint of the interior side aperture is located at a second distance from a bottom side of the block, wherein the first distance is less than the second distance;

a volume between the exterior side aperture and the interior side aperture, wherein the volume is defined by at least a first and second interior partition, and wherein the first and second interior partition prevent incursion of a bonding material into the volume that would otherwise obstruct insertion of one or more portions of the plumbing fixture through the exterior side aperture and the interior side aperture.

2. The block of claim 1, wherein the block comprises one or more of aluminum, steel, and brick.

3. The block of claim 1, further comprising a plurality of recesses on a top surface of the block for receiving a bonding material.

4. The block of claim 1, further comprising a textured surface on an exterior side of the brick.

5. The block of claim 4, further comprising a finish applied to the textured surface.

6. The block of claim 1, wherein one or more of the exterior side aperture and interior side aperture is threaded.

7. The block of claim 1, wherein a diameter of one or more of the exterior side aperture and interior side aperture is selected based on a diameter of a pipe portion of the fixture.

8. The block of claim 1, further comprising a reinforcing portion around one or more of the exterior side aperture and interior side aperture.

9. A block for locating a plumbing fixture comprising:

an exterior side aperture;

an interior side aperture;

a plurality of recesses disposed upon a top side of the block; and a channel extending between the exterior side aperture and the interior side aperture, wherein the channel is configured to receive and hold at least a portion of the plumbing fixture, a piping, or a combination thereof.

10. The block of claim 9, wherein a midpoint of the exterior side aperture is located at a first distance from a bottom side of the block; and a midpoint of the interior side aperture is located at a second distance from a bottom side of the block, wherein the first distance is less than the second distance.

11. The block of claim 9, further comprising a volume between the exterior side aperture and the interior side aperture, wherein the volume is defined by at least a first and second interior partition.

12. The block of claim 9, further comprising a plurality of recesses disposed upon a bottom side of the block.

13. The block of claim 9, wherein at least a medial portion of the block is hollow, and the channel comprises a tubular structure that extends continuously from the exterior side aperture to the interior side aperture.

14. The block of claim 9, wherein at least a medial portion of the block is substantially solid, and the channel comprises a hole extending from the exterior side aperture and the interior side aperture.

15. The block of claim 9, wherein the block comprises one or more of aluminum, steel, and brick.

16. The block of claim 9, further comprising a textured surface on an exterior side of the brick.

17. The block of claim 16 further comprising a finish applied to the textured surface.

18. The block of claim 9, wherein one or more of the exterior side aperture and interior side aperture is threaded.

19. The block of claim 9, wherein a diameter of one or more of the exterior side aperture and interior side aperture is selected based on a diameter of a pipe portion of the fixture.

20. A method of locating a plumbing fixture, the method comprising:

providing a block configured to receive and hold the plumbing fixture, the block comprising:

an exterior side aperture, wherein a midpoint of the exterior side aperture is located at a first distance from a bottom side of the block;

an interior side aperture, wherein a midpoint of the interior side aperture is located at a second distance from a bottom side of the block, wherein the first distance is less than the second distance;

providing the plumbing fixture and a piping;

passing the piping through the interior side aperture;

passing at least a portion of the plumbing fixture through the exterior side aperture; and securing an exterior side of the plumbing fixture to an exterior side of the block.

* * * * *